US008608498B2

(12) United States Patent
Suzuki et al.

(10) Patent No.: US 8,608,498 B2
(45) Date of Patent: Dec. 17, 2013

(54) CONNECTOR

(75) Inventors: Sachio Suzuki, Hitachi (JP); Hideaki Takehara, Hitachi (JP); Kunihiro Fukuda, Tsukuba (JP); Yuta Kataoka, Hitachi (JP); Jun Umetsu, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 13/344,989

(22) Filed: Jan. 6, 2012

(65) Prior Publication Data

US 2012/0184125 A1 Jul. 19, 2012

(30) Foreign Application Priority Data

Jan. 13, 2011 (JP) ..... 2011-005001
Sep. 9, 2011 (JP) ..... 2011-196690

(51) Int. Cl.
*H01R 13/15* (2006.01)

(52) U.S. Cl.
USPC ..... 439/262; 439/265; 439/269.2

(58) Field of Classification Search
USPC ..... 439/259, 266, 269.1, 269.2, 262, 263, 439/265
See application file for complete search history.

(56) References Cited

U.S. PATENT DOCUMENTS 7,892,038 B1 * 2/2011 Kataoka et al. ..... 439/660
7,922,518 B1 * 4/2011 Takehara et al. ..... 439/485
7,955,110 B1 * 6/2011 Kataoka et al. ..... 439/284
7,959,470 B1 * 6/2011 Umetsu et al. ..... 439/626
7,980,879 B2 * 7/2011 Suzuki et al. ..... 439/346
7,985,092 B2 * 7/2011 Suzuki et al. ..... 439/346
8,100,708 B2 * 1/2012 Kataoka et al. ..... 439/271
8,105,099 B2 * 1/2012 Suzuki et al. ..... 439/157
8,123,546 B2 * 2/2012 Suzuki et al. ..... 439/372
8,123,573 B2 * 2/2012 Takehara et al. ..... 439/845
8,182,275 B2 * 5/2012 Suzuki et al. ..... 439/157
8,182,278 B2 * 5/2012 Kataoka et al. ..... 439/266
8,202,115 B2 * 6/2012 Suzuki et al. ..... 439/604
8,202,116 B2 * 6/2012 Suzuki et al. ..... 439/607.01
8,226,429 B2 * 7/2012 Umetsu et al. ..... 439/262
8,272,887 B2 * 9/2012 Fukuda et al. ..... 439/372
8,272,891 B2 * 9/2012 Kataoka et al. ..... 439/540.1
8,277,250 B2 * 10/2012 Suzuki et al. ..... 439/604
8,277,259 B2 * 10/2012 Hattori et al. ..... 439/660
8,308,508 B2 * 11/2012 Suzuki et al. ..... 439/540.1

(Continued)

FOREIGN PATENT DOCUMENTS

JP 2004-056924 A 2/2004
JP 2009-70754 A 4/2009

*Primary Examiner* — Ross Gushi
(74) *Attorney, Agent, or Firm* — Roberts Mlotkowski Safran & Cole, P.C.

(57) ABSTRACT

A connector includes a first terminal housing for housing plural first connecting terminals aligned, a second terminal housing for housing plural second connecting terminals aligned, plural insulating members, a connecting member for collectively fixing and electrically connecting the plural first connecting terminals and the plural second connecting terminals at each contact point by pressing the plural first connecting terminals and the plural second connecting terminals. The connecting member includes a ring-shaped support fixed to the first terminal housing and a pressing portion an upper part of which is inserted into a hollow formed inside the ring-shaped support so as to be pivotally supported by the support. The pressing portion is configured to turn relative to the support by turning the upper part of the pressing portion and to move relative to the support with the turning of the pressing portion in a vertical direction.

11 Claims, 9 Drawing Sheets

(56) References Cited

U.S. PATENT DOCUMENTS

| | | | | |
|---|---|---|---|---|
| 8,517,753 | B2 * | 8/2013 | Kataoka et al. | 439/261 |
| 2011/0130021 | A1 * | 6/2011 | Suzuki et al. | 439/271 |
| 2011/0130022 | A1 * | 6/2011 | Suzuki et al. | 439/271 |
| 2011/0130023 | A1 * | 6/2011 | Kataoka et al. | 439/271 |
| 2011/0130028 | A1 * | 6/2011 | Takehara et al. | 439/485 |
| 2011/0151707 | A1 * | 6/2011 | Umetsu et al. | 439/391 |
| 2011/0159717 | A1 * | 6/2011 | Umetsu et al. | 439/296 |
| 2011/0159728 | A1 * | 6/2011 | Suzuki et al. | 439/587 |
| 2011/0159729 | A1 * | 6/2011 | Suzuki et al. | 439/587 |
| 2011/0159731 | A1 * | 6/2011 | Kataoka et al. | 439/604 |
| 2011/0189883 | A1 * | 8/2011 | Suzuki et al. | 439/372 |
| 2011/0189891 | A1 * | 8/2011 | Suzuki et al. | 439/607.01 |
| 2011/0250770 | A1 * | 10/2011 | Suzuki et al. | 439/157 |
| 2011/0250771 | A1 * | 10/2011 | Suzuki et al. | 439/157 |
| 2011/0250801 | A1 * | 10/2011 | Kataoka et al. | 439/668 |
| 2012/0052734 | A1 * | 3/2012 | Fukuda et al. | 439/626 |
| 2012/0052747 | A1 * | 3/2012 | Kataoka et al. | 439/701 |
| 2012/0077360 | A1 * | 3/2012 | Hattori et al. | 439/153 |
| 2012/0156916 | A1 * | 6/2012 | Suzuki et al. | 439/345 |
| 2012/0184123 | A1 * | 7/2012 | Fukuda et al. | 439/271 |
| 2012/0184125 | A1 * | 7/2012 | Suzuki et al. | 439/345 |
| 2012/0184149 | A1 * | 7/2012 | Suzuki et al. | 439/660 |
| 2012/0184152 | A1 * | 7/2012 | Kataoka et al. | 439/660 |
| 2012/0244755 | A1 * | 9/2012 | Suzuki et al. | 439/660 |
| 2012/0322319 | A1 * | 12/2012 | Umetsu et al. | 439/692 |
| 2012/0329337 | A1 * | 12/2012 | Kataoka et al. | 439/692 |

* cited by examiner

CONNECTOR

The present application is based on Japanese patent application Nos. 2011-005001 and 2011-196690 filed on Jan. 13, 2011 and Sep. 9, 2011, respectively, the entire contents of which are incorporated herein by reference.

BACKGROUND OF THE INVENTION

1. Field of the Invention

The invention relates to a connector which is used for, e.g., an eco-friendly car such as a hybrid car and an electric car, in particular, to a connector which may be potentially employed for a power harness used for transmitting a large amount of power.

2. Description of the Related Art

A power harness is used for connecting between devices such as between a motor and an inverter or between an inverter and a battery in, e.g., a hybrid car or an electric car, which has made significant progress in recent years, for transmitting a large amount of power, and a connector in a two-divided structure composed of, e.g., a male connector portion provided with a male terminal as well as a first terminal housing for housing the male terminal and a female connector portion provided with a female terminal connected to the male terminal as well as a second terminal housing for housing the female terminal is provided to one end of the power harness (see, e.g., JP-A-2009-070754).

In recent years, all components in such an eco-friendly car have been lightened in weight in order to improve energy saving performance, and size reduction is desired as one of effective means of reducing weight.

A technique of Japanese patent No. 4037199 is an example of a known technique.

The technique described in Japanese patent No. 4037199 is an electric connection structure for vehicle in which connecting terminals of plural phases of conductive member led out from a vehicle driving motor are connected to connecting terminals of plural phases of power line cable led out from an inverter for driving the motor, a connecting terminal of each phase of the conductive member overlaps a corresponding connecting terminal of each phase of the power line cable, an insulating member is arranged on a surface opposite to an overlapping surface of the connecting terminals, and the overlapped connecting terminals of each phase are tightened and fixed to the insulating members in an overlapping direction by a single bolt provided at a position to penetrate therethrough.

In other words, the technique of Japanese patent No. 4037199 is a connection structure in which plural connecting terminals and insulating members compose a laminated structure and the connecting terminals are fixed and electrically connected all together at contact points by tightening a single bolt in an overlapping direction (or a lamination direction) while plural contact points as an overlapping surfaces between the connecting terminals are sandwiched, and this kind of configuration is more effective in easy downsizing than the technique of JP-A-2009-070754.

SUMMARY OF THE INVENTION

The inventors have tried to use such a laminated-type connection structure for the connector.

Then, they conceived a configuration to screw into the housing the head portion of the bolt described in Japanese patent No. 4037199.

However, this configuration has the following problems.

For example, in recent years, the housing of connectors is generally formed of aluminum which is effective for reducing the weight in vehicle use. Therefore, using aluminum as a material of the housing, the above configuration can be provided by screwing the head portion of the bolt into the housing. In this case, a problem may arise that the aluminum housing is abraded due to the friction between a screw groove and a screw thread.

Especially when used for a vehicle, a pressing force needs to be applied via a spring to a contact point in the laminated-type connection structure as described above in order to address the problem of vibration which is inherent in vehicles. Thus, in such a configuration with the spring, a load on the screwed portion increases and the above problem becomes remarkable.

In short, the conventional connector may have a problem that the durability of a turn mechanism for turning a connecting member such as a bolt is low.

Accordingly, it is an object of the invention to provide a connector with improved durability of a turn mechanism for turning a connecting member.

(1) According to one embodiment of the invention, a connector comprises:

a first terminal housing for housing a plurality of first connecting terminals aligned;

a second terminal housing for housing a plurality of second connecting terminals aligned;

a plurality of insulating members;

a laminated structure that one surface of the plurality of first connecting terminals faces one surface of the plurality of second connecting terminals to form pairs and to form a plurality of contact points sandwiched between the plurality of insulating members when the first terminal housing is fitted to the second terminal housing; and a connecting member for collectively fixing and electrically connecting the plurality of first connecting terminals and the plurality of second connecting terminals at each contact point by pressing the plurality of first connecting terminals and the plurality of second connecting terminals, wherein the connecting member comprises a ring-shaped support fixed to the first terminal housing and a pressing portion an upper part of which is inserted into a hollow formed inside the ring-shaped support so as to be pivotally supported by the support, and wherein the pressing portion is configured to turn relative to the support by turning the upper part of the pressing portion and to move relative to the support with the turning of the pressing portion in a vertical direction.

In the above embodiment (1) of the invention, the following modifications and changes can be made.

(i) The support comprises a ring-shaped frame fixed to the first terminal housing and a sliding protrusion protruding downward from the frame, wherein the pressing portion comprises a columnar main body, an upper part of the columnar main body being inserted into a hollow formed inside the frame and a lower part thereof being pressed toward the plurality of contact points, and a sliding receiving portion that comprises a stepped portion formed circumferentially on a side surface of the columnar main body and having a stepped surface on top thereof so as to restrict upward movement of the main body relative to the frame by contacting a lower end of the sliding protrusion with the stepped surface to position the pressing portion relative to the support in the vertical direction, and wherein the pressing portion is configured to move relative to the support in the vertical direction with the turning of the pressing portion by changing a vertical position of the stepped surface of the sliding receiving portion in a circumferential direction of the main body.

(ii) The sliding receiving portion comprises a horizontal portion formed perpendicular to the vertical direction, and a slope formed to extend diagonally downward along the side surface of the main body from an end of the first horizontal portion.

(iii) The first horizontal portion comprises a concave protrusion supporting portion for housing the lower end of the sliding protrusion.

(iv) The sliding protrusion comprises an engagement portion for engaging the frame with the first terminal housing.

(v) The support comprises a ring-shaped frame fixed to the first terminal housing and a sliding protrusion protruding downward from the frame, wherein the pressing portion comprises a columnar main body, a lower part thereof being pressed toward the plurality of contact points, and a sliding receiving portion that comprises a stepped portion formed circumferentially on a side surface of the columnar main body and having a stepped surface on top thereof so as to restrict upward movement of the main body relative to the frame by contacting a lower end of the sliding protrusion with the stepped surface to position the pressing portion relative to the support in the vertical direction, and wherein the pressing portion is configured to move relative to the support in the vertical direction with the turning of the pressing portion by changing a vertical position of the stepped surface of the sliding receiving portion in a circumferential direction of the main body.

EFFECTS OF THE INVENTION

According to one embodiment of the invention, a connector with improved durability of a turn mechanism for turning a connecting member can be provided.

BRIEF DESCRIPTION OF THE DRAWINGS

Next, the present invention will be explained in more detail in conjunction with appended drawings, wherein:

FIGS. 1A and 1B are diagrams illustrating a connector in an embodiment of the present invention, wherein FIG. 1A is a cross sectional view and FIG. 1B is a perspective view showing a connecting member;

FIGS. 3A and 3B are diagrams illustrating a first connector portion of the connector in FIG. 1, wherein FIG. 3A is a cross sectional view and FIG. 3B is a cross sectional view thereof taken on line 3B-3B which is seen through a resin molded body;

FIGS. 4A and 4B are diagrams illustrating first connecting terminals and an insulating member assembly of the connector in FIG. 1, wherein FIG. 4A is a side view and FIG. 4B is a cross sectional view thereof taken on line 4B-4B;

FIGS. 5A and 5B are diagrams illustrating a second connecting terminal of the connector in FIG. 1, wherein FIG. 5A is a side view and FIG. 5B is a top view;

FIGS. 6A and 6B are diagrams illustrating a second connecting terminal of the connector in FIG. 1, wherein FIG. 6A is a side view and FIG. 6B is a top view;

FIGS. 7A to 7C are explanatory diagrams illustrating a turn operation of the connecting member of the connector in FIG. 1, wherein FIG. 7A is a side view of the connecting member, FIG. 7B is a perspective view thereof and FIG. 7C is an extracted side view of a connected portion of first connecting terminals and second connecting terminals;

FIGS. 8A to 8C are explanatory diagrams illustrating a turn operation of the connecting member of the connector in FIG. 1, wherein FIG. 8A is a side view of the connecting member, FIG. 8B is a perspective view thereof and FIG. 8C is an extracted side view of a connected portion of the first connecting terminals and the second connecting terminals;

FIGS. 9A to 9C are explanatory diagrams illustrating a turn operation of the connecting member of the connector in FIG. 1, wherein FIG. 9A is a side view of the connecting member, FIG. 9B is a perspective view thereof and FIG. 9C is an extracted side view of a connected portion of the first connecting terminals and the second connecting terminals;

FIGS. 10A to 10C are explanatory diagrams illustrating a turn operation of the connecting member of the connector in FIG. 1, wherein FIG. 10A is a side view of the connecting member, FIG. 10B is a perspective view thereof and FIG. 10C is an extracted side view of a connected portion of the first connecting terminals and the second connecting terminals; and FIGS. 11A and 11B are diagrams illustrating a connecting member in a modification of the invention, wherein FIG. 11A is a perspective view and FIG. 1B is a cross sectional view.

DETAILED DESCRIPTION OF THE PREFERRED EMBODIMENTS

Embodiments of the invention will be described below in conjunction with the appended drawings.

Figure 1A:
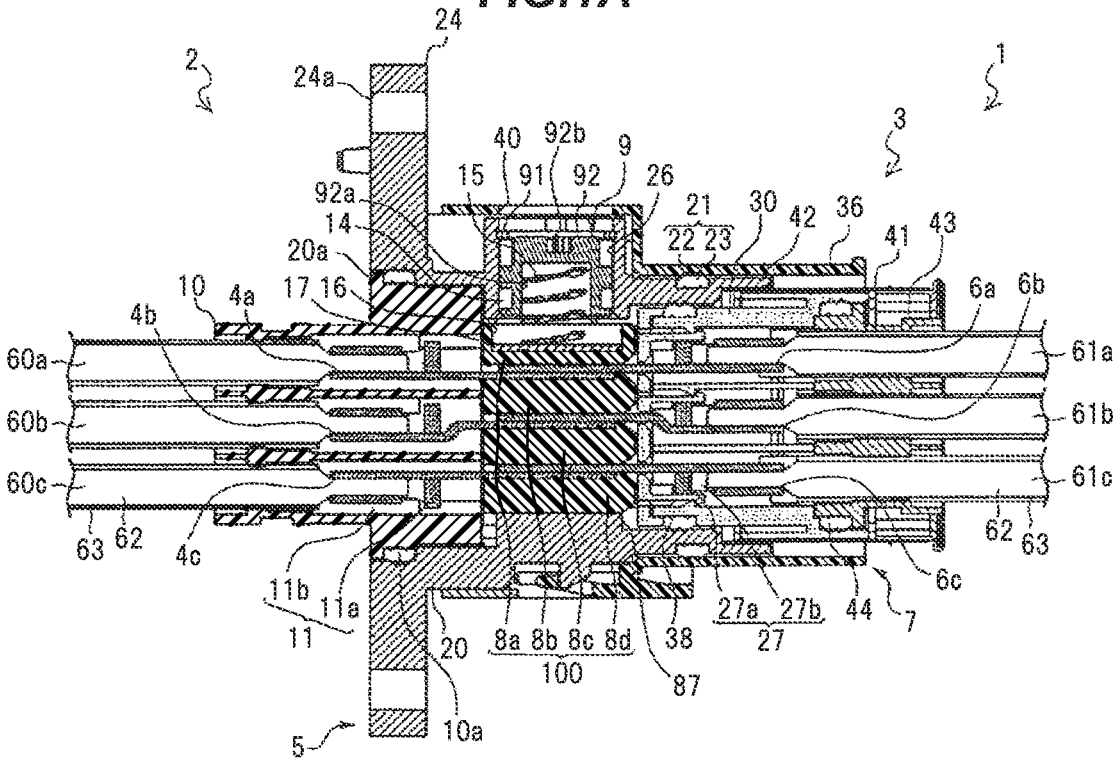
Figure 1B:
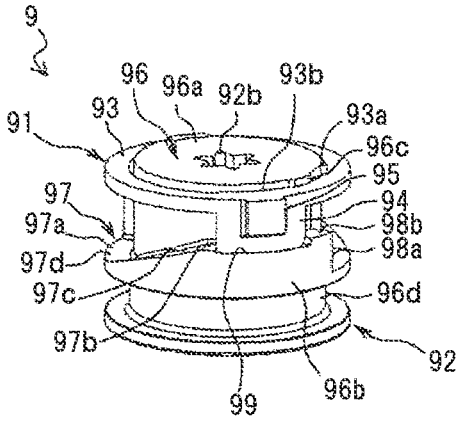
Figure 2A:
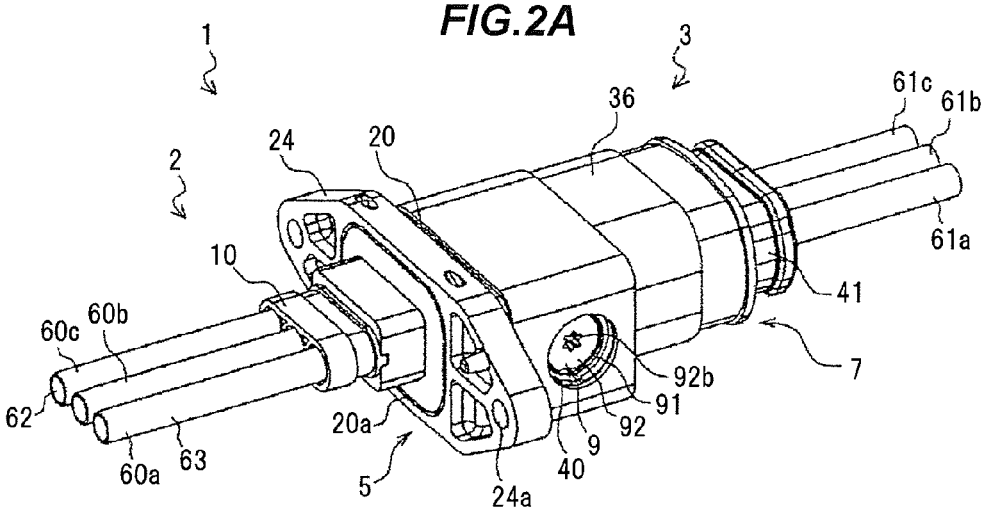
FIG. 2A is a perspective view showing the connector in FIG. 1
Figure 2B:
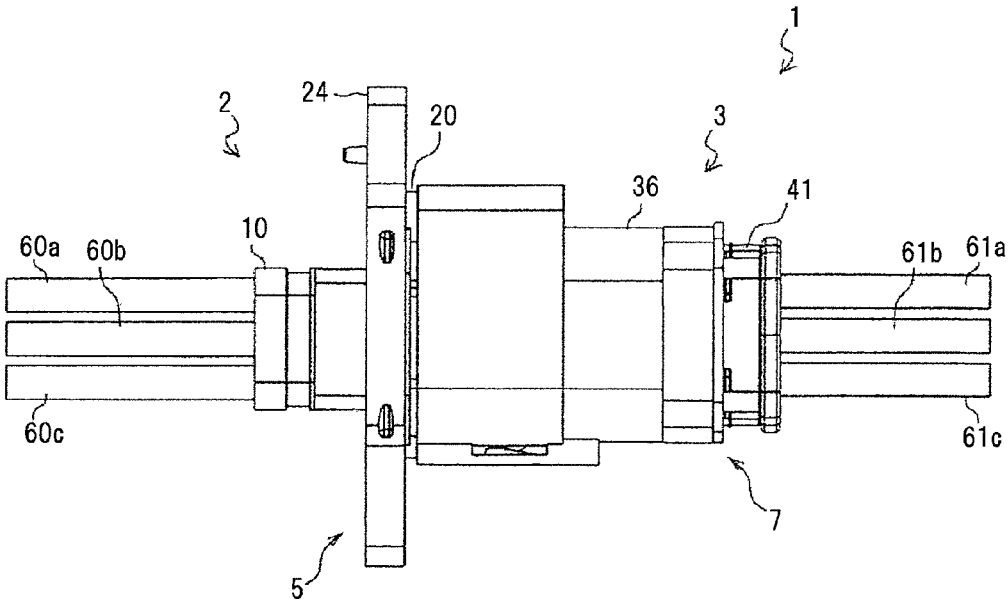
FIG. 2B is a plan view thereof.
Figure 3A:
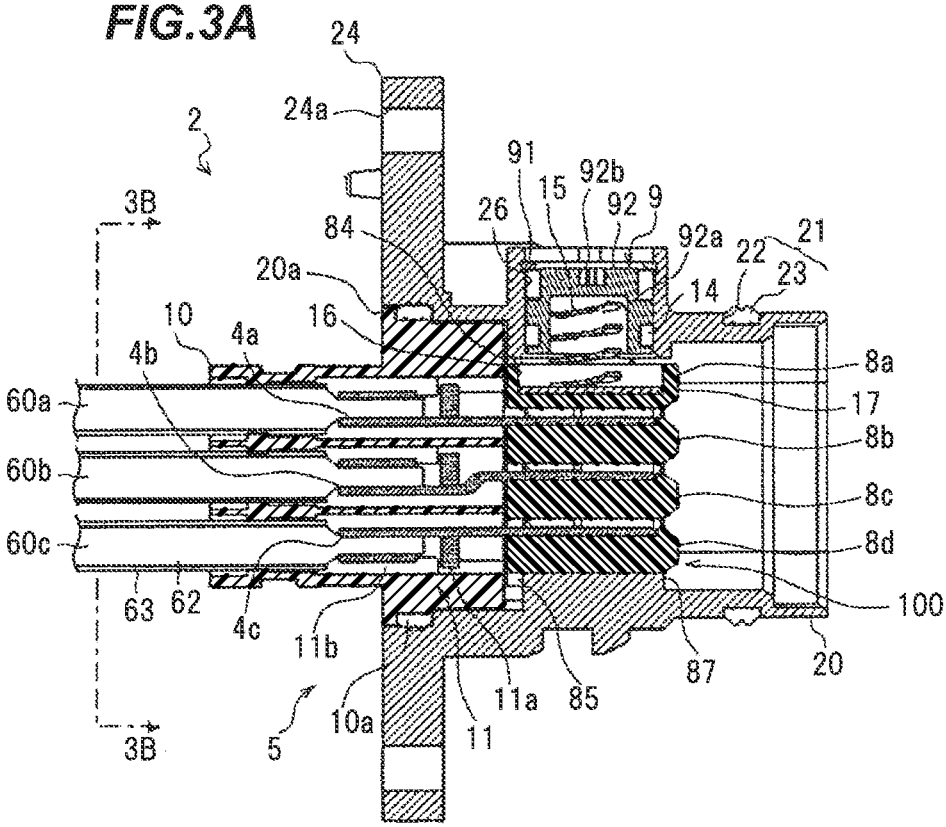
Figure 3B:
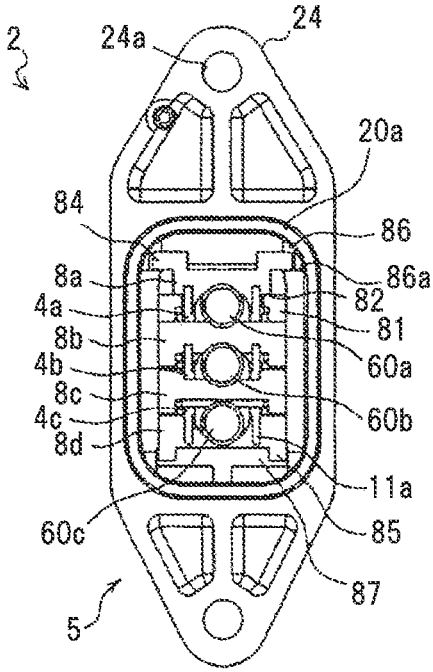

FIGS. 1A, 1B, 2A and 2B are diagrams illustrating a connector in the present embodiment, wherein FIG. 1A is a cross sectional view, FIG. 1B is a perspective view showing a connecting member, FIG. 2A is a perspective view and FIG. 2B is a plan view.

As shown in FIGS. 1A, 1B, 2A and 2B, a connector 1 in the present embodiment is composed of a first connector portion 2 and a second connector portion 3, and plural power lines are connected at a time by fitting the connector portions 2 and 3 together.

More specifically, the connector 1 is provided with the first connector portion 2 having a first terminal housing (male terminal housing) 5 housing plural (three) aligned first connecting terminals (male terminals) 4*a* to 4*c*, the second connector portion 3 having a second terminal housing (female terminal housing) 7 housing plural (three) aligned second connecting terminals (female terminals) 6*a* to 6*c*, and plural (four) insulating members 8*a* to 8*d* aligned and housed in the first terminal housing 5 for insulating the first connecting terminals 4*a* to 4*c* from each other, and is configured that, in the first connector portion 2 and the second connector portion 3 which are fitted to each other, the first connecting terminals 4*a* to 4*c* and the second connecting terminals 6*a* to 6*c* are alternately arranged to form a laminated structure in which surfaces of the plural first connecting terminals 4*a* to 4*c* on one side face surfaces of the plural second connecting terminals 6*a* to 6*c* on one side to form respective pairs (a pair of the first connecting terminal 4*a* and the second connecting terminal 6*a*, that of the first connecting terminal 4*b* and the second connecting terminal 6*b*, and that of the first connecting terminal 4*c* and the second connecting terminal 6*c*) and to form plural contact points, and each contact point is sandwiched by the insulating members 8*a* to 8*d*.

In the connector 1, cables 60*a* to 60*c* are connected to the first connector portion 2 and cables 61*a* to 61*c* are connected to the second connector portion 3, and the cables 60*a* to 60*c* are respectively electrically connected to the cables 61*a* to

61*c* by connecting the first connector portion 2 to the second connector portion 3. That is, the connector 1 is used to connect cables.

The connector 1 is used for connecting, e.g., a motor for driving a vehicle to an inverter for driving the motor. In the present embodiment, the cables 60*a* to 60*c* extending from a motor and the cables 61*a* to 61*c* extending from an inverter will be described as an example.

Each configuration of the connector portions 2 and 3 will be described in detail below.

First Connector Portion

Firstly, the first connector portion 2 will be described.

As shown in FIGS. 1A to 3B, the first connector portion 2 holds, inside thereof, three first connecting terminals 4*a* to 4*c* aligned at predetermined intervals, and is provided with the first terminal housing 5 housing the three aligned first connecting terminals 4*a* to 4*c*, plural insulating members 8*a* to 8*d* in a substantially rectangular parallelepiped shape which are provided in the first terminal housing 5 for insulating the first connecting terminals 4*a* to 4*c* from each other, and a connecting member 9 for collectively fixing and electrically connecting the plural first connecting terminals 4*a* to 4*c* to the plural second connecting terminals 6*a* to 6*c* at respective contact points by pressing the adjacent insulating member 8*a*.

The cables 60*a* to 60*c* extending from a motor are respectively connected to edges of the first connecting terminals 4*a* to 4*c* on one side. The cables 60*a* to 60*c* are each composed of a conductor 62 and an insulation layer 63 formed on the outer periphery thereof. The conductor 62 having a cross-sectional area of 20 $mm^2$ is used in the present embodiment.

Electricity of different voltage and/or current is transmitted to each of the cables 60*a* to 60*c*. For example, the present embodiment assumes the use of a three-phase AC power line between a motor and an inverter, and alternate current having a phase difference of 120° is transmitted to each of the cables 60*a* to 60*c* and the first connecting terminals 4*a* to 4*c*. Each of the first connecting terminals 4*a* to 4*c* should be formed of a highly conductive metal such as silver, copper or aluminum to reduce transmission loss, etc., in the connector 1. In addition, each of the first connecting terminals 4*a* to 4*c* has little flexibility.

The cables 60*a* to 60*c* are each aligned and held at predetermined intervals by a resin molded body (inner housing) 10 which is in a multi-cylindrical shape (contiguous plural cylinders). The first connecting terminals 4*a* to 4*c* are fixed to the first terminal housing 5 via the cables 60*a* to 60*c* and the resin molded body 10.

The resin molded body 10 is formed of an insulating resin (e.g., PPS (polyphenylene sulfide) resin, PPA (polyphthalamide) resin, PA (polyamide) resin, PBT (polybutylene terephthalate) and epoxy-based resin), etc., to prevent short circuit by insulating the first connecting terminals 4*a* to 4*c* from each other. The resin molded body 10 allows the first connecting terminals 4*a* to 4*c* to be held at respective predetermined positions even when each of the cables 60*a* to 60*c* respectively connected to the first connecting terminals 4*a* to 4*c* is very flexible. In other words, since a cable excellent in flexibility can be used as the cables 60*a* to 60*c* in the present embodiment, it is possible to improve the wiring flexibility for laying the cables 60*a* to 60*c*.

The resin molded body 10 positions the first connecting terminals 4*a* to 4*c* by holding the cables 60*a* to 60*c*, in more detail, the resin molded body 10 holds the end portion of the cables 60*a* to 60*c* at a position close to the first connecting terminals 4*a* to 4*c* so that the first connecting terminals 4*a* to 4*c* are held at predetermined positions, however, the resin molded body 10 may directly hold and position the first connecting terminals 4*a* to 4*c* while holding the cables 60*a* to 60*c*. Alternatively, a connecting terminal holding member for directly holding the first connecting terminals 4*a* to 4*c* without holding the cables 60*a* to 60*c* may be used in place of the resin molded body 10.

In a case that the resin molded body 10 positions the first connecting terminals 4*a* to 4*c* by holding the cables 60*a* to 60*c* without directly holding the first connecting terminals 4*a* to 4*c*, i.e., in the case as is the present embodiment, use of flexible cables 60*a* to 60*c* allows the tips of the first connecting terminals 4*a* to 4*c* to flexibly move with respect to the first terminal housing 5, and it is thereby possible to suppress deformation of the first connecting terminals 4*a* to 4*c* caused by pressure from the connecting member 9.

The first connector portion 2 is provided with a slip-off preventing mechanism 11 so that the cables 60*a* to 60*c* are not pulled out from the resin molded body 10 even when the cables 60*a* to 60*c* are pulled. The slip-off preventing mechanism 11 is composed of a protrusion 11*a* each formed at the proximal ends of the first connecting terminals 4*a* to 4*c* (in the vicinity of the cables 60*a* to 60*c*) and a locking projection 11*b* which is provided in each cylinder of the multi-cylindrical resin molded body 10 in a protruding manner to restrict backward movement (toward the left side in FIG. 1A) of the protrusion 11*a* by locking with the protrusion 11*a*.

Figure 4A:
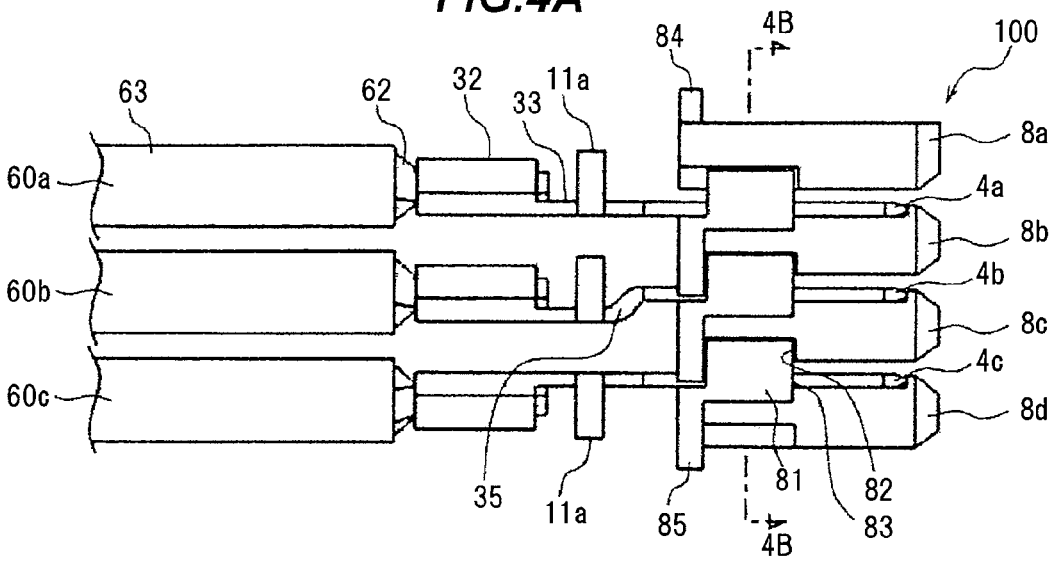
Figure 4B:
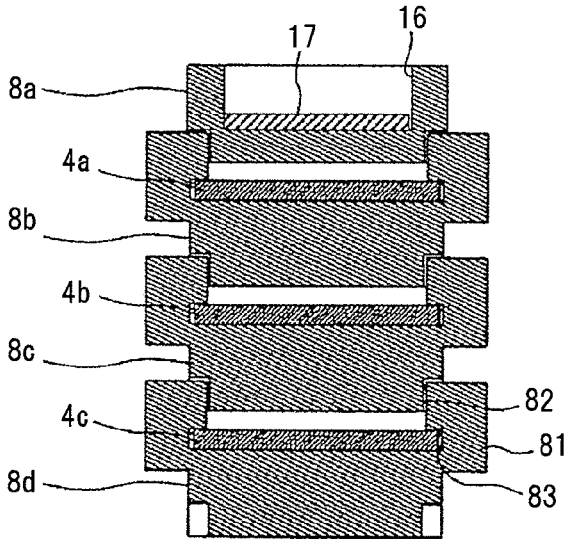
Figure 5A:
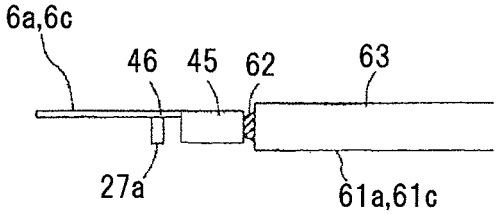
Figure 5B:
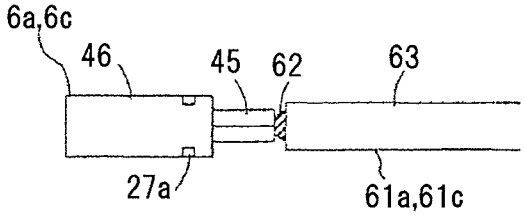
Figure 6A:
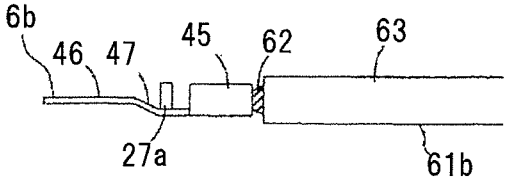
Figure 6B:
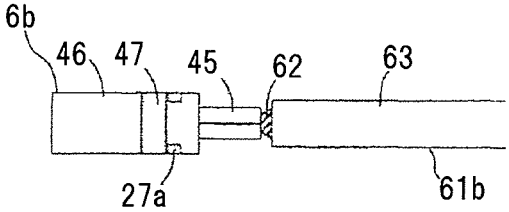

As shown in FIG. 4A, each of the first connecting terminals 4*a* to 4*c* has a caulking portion 32 for caulking the conductor 62 which is exposed at end portions of the cables 60*a* to 60*c* and a plate-like contact point 33 integrally formed with the caulking portion 32. The protrusions 11*a* of the slip-off preventing mechanism 11 are formed to protrude upward (downward) from both widthwise end portions of the plate-like contact point 33 at the proximal end thereof (see FIG. 3B).

Meanwhile, the present embodiment is configured such that the cables 60*a* to 60*c* are aligned and held with as little clearance as possible in order to downsize the connector 1. Therefore, a trunk portion 35 of the first connecting terminals 4*b* connected to the cable 60*b* which is arranged in the middle when aligned is bent so that the first connecting terminals 4*a* to 4*c* are arranged at equal intervals.

As shown in FIGS. 1A to 4B, among the plural insulating members 8*a* to 8*d*, the plural first insulating members 8*b* to 8*d* are aligned and housed in the first terminal housing 5 and are also provided integrally with the respective surfaces of the plural first connecting terminals 4*a* to 4*c* on another side (surfaces opposite to the surfaces connected to the second connecting terminals 6*a* to 6*c*), and a second insulating member 8*a* is provided so as to face the surface of the outermost second connecting terminal 6*a* (the uppermost side in FIG. 1A) on another side (a surface opposite to the surface connected to the first connecting terminal 4*a*) when the plural first connecting terminals 4*a* to 4*c* and the plural second connecting terminals 6*a* to 6*c* form a laminated state.

The first insulating members 8*b* to 8*d* are fixed to the first connecting terminals 4*a* to 4*c* at positions to protrude on the tip side. Each corner of the first insulating members 8*b* to 8*d* on a side to insert and extract the second connecting terminals 6*a* to 6*c* is chamfered. In addition, a corner of the second insulating member 8*a* on a side to insert and extract the second connecting terminals 6*a* to 6*c* and also on the first insulating member 8*b* side is also chamfered. Furthermore, a protruding portion (a build-up surface) for filling a level difference from the first connecting terminals 4*a* to 4*c* is each formed on the surfaces of the first insulating members 8*b* to 8*d* to which the first connecting terminals 4*a* to 4*c* are fixed so that the upper surfaces (upper side in the drawing) of the first insulating members 8*b* to 8*d* are respectively flush with the upper surfaces (upper side in the drawing) of the plural first connecting terminals 4*a* to 4*c*. Due to this configuration, the tip portions of the first connecting terminals 4*a* to 4*c* do not contact with the tip portions of the second connecting terminals 6*a* to 6*c* to be inserted when the first connector portion 2 is fitted to the second connector portion 3, hence, an effect of improving insertability of the second connecting terminals 6*a* to 6*c*.

In the connector 1 of the present embodiment, an insulating member assembly 100 is formed by connecting the insulating members 8*a* to 8*d* each other to restrict movement thereof in a fitting direction (a horizontal direction in FIG. 1A) and movement of the laminated structure in a width direction (a direction toward a paper face of FIG. 1A) which is perpendicular to a lamination direction (a vertical direction in FIG. 1A) and to the fitting direction.

As shown in FIGS. 3A to 4B, the insulating member assembly 100 is formed by sequentially connecting each of the insulating members 8*a* to 8*d* in the lamination direction. That is, the insulating member assembly 100 is formed by respectively connecting the second insulating member 8*a* to the first insulating member 8*b*, the first insulating member 8*b* to the first insulating member 8*c*, and the first insulating member 8*c* to the first insulating member 8*d*.

A connecting piece 81 extending from both widthwise end portions of the first insulating members 8*b* to 8*d* toward the opposite insulating members 8*a* to 8*c* (toward the second insulating member 8*a* from the first insulating member 8*b*, the first insulating member 8*b* from the first insulating member 8*c* and the first insulating member 8*c* from the first insulating member 8*d*) with the first connecting terminals 4*a* to 4*c* interposed therebetween on which the first insulating members 8*b* to 8*d* are fixed is each integrally formed on the first insulating members 8*b* to 8*d*. In addition, a connecting groove 82 for receiving the connecting piece 81 to be slidable in the lamination direction is each formed on the both side surfaces of the insulating members 8*a* to 8*c* opposite to the first insulating members 8*b* to 8*d* (facing with the first connecting terminals 4*a* to 4*c* interposed therebetween to which the first insulating members 8*b* to 8*d* are fixed).

The insulating members 8*a* to 8*d* are each connected to be relatively movable in the lamination direction by respectively receiving the connecting piece 81 of the first insulating member 8*b* in the connecting groove 82 of the second insulating member 8*a*, the connecting piece 81 of the first insulating member 8*c* in the connecting groove 82 of the first insulating member 8*b* and the connecting piece 81 of the first insulating member 8*d* in the connecting groove 82 of the first insulating member 8*c*, and the insulating member assembly 100 is thereby formed.

The connecting groove 82 is formed so that the width thereof in the fitting direction is substantially equal to that of the connecting piece 81 to be received. This restricts the movement of the insulating members 8*a* to 8*d* in the fitting direction. Furthermore, the connecting pieces 81 formed at the both widthwise end portions of the first insulating members 8*b* to 8*d* are received by the connecting grooves 82 formed on the both side surfaces of the opposite insulating members 8*a* to 8*c*, and thus, the opposite insulating members 8*a* to 8*c* are sandwiched by the connecting pieces 81 in the width direction, which restricts the widthwise movement of the insulating members 8*a* to 8*d*.

A squared U-shaped fitting groove 83 is formed at the proximal end of each connecting piece 81 and the first insulating members 8*b* to 8*d* are fixed to the first connecting terminals 4*a* to 4*c* by fitting the first connecting terminals 4*a* to 4*c* to the fitting grooves 83. As a result, the first insulating members 8*b* to 8*d* are held by the first terminal housing 5 via the first connecting terminals 4*a* to 4*c*, the cables 60*a* to 60*c* and the resin molded body 10, and the first insulating members 8*b* to 8*d* are thereby positioned with respect to the first terminal housing 5.

In addition, engagement portions 84 and 85 for engaging the insulating member assembly 100 with the first terminal housing 5 are respectively formed at both end portions of the insulating member assembly 100 in the lamination direction, i.e., formed on the second insulating member 8*a* and the first insulating members 8*d* which are located outermost.

It is configured that the engagement portion 84 is engaged with a partition wall 86 formed on the inner peripheral surface of the first terminal housing 5 and the engagement portion 85 is engaged with a base 87 formed on the inner peripheral surface of the first terminal housing 5 at an opposite position to a below-described connecting member insertion hole 26 (on the lower side in FIG. 3B) to position the insulating member assembly 100 in the fitting direction with respect to the first terminal housing 5. A stepped portion 86*a* is formed on the partition wall 86 so that the engagement portion 84 does not move down beyond the stepped portion 86*a* (toward the first insulating member 8*b*).

By forming the insulating member assembly 100, it is possible to prevent the positions of the insulating members 8*a* to 8*d* from being misaligned even when a force (e.g., a force to pull the cables 60*a* to 60*c* or a force to push the cables 60*a* to 60*c* into the first connector portion 2) is applied to the cables 60*a* to 60*c*, and as a result, it is possible to prevent the second connecting terminals 6*a* to 6*c* from butting against the insulating members 8*a* to 8*d* at the time of connecting the two connector portions 2 and 3 and a fitting operation can be smoothly carried out.

Referring to FIGS. 1A to 3B again, in the present embodiment, the connecting member 9 has a ring-shaped support 91 fixed to the first terminal housing 5 and a pressing portion 92 of which upper portion is inserted into a hollow formed inside the ring-shaped support 91 so as to be pivotably supported thereby.

An irregular-shaped hole (a star-shaped hole, here) 92*b* for fitting a tool such as a wrench is formed on the upper surface of the pressing portion 92 (on a surface opposite to the second insulating member 8*a*), and the connecting member 9 is configured such that the pressing portion 92 is turned relative to the support 91 by turning the upper portion of the pressing portion 92, vertically moves relative to the support 91 (in a lamination direction which is a vertical direction in FIG. 1A) with the turning, and then presses the adjacent second insulating member 8*a*. The detailed structure of the connecting member 9 will be described later.

In addition, an elastic member 15 for imparting a predetermined pressing force to the second insulating member 8*a* is provided between the lower surface of the pressing portion 92 of the connecting member 9 and the upper surface of the second insulating member 8*a* immediately thereunder. In the present embodiment, a concave portion 92*a* is formed on the lower surface of the pressing portion 92 to house the upper portion of the elastic member 15 therein. This is an idea to reduce a distance between the pressing portion 92 and the second insulating member 8*a* and to downsize the connector 1 even when the elastic member 15 is long to some extent. The elastic member 15 is composed of, e.g., a spring formed of metal (e.g., SUS, etc.). The elastic member 15 is regarded as a portion of the connecting member 9 in the present embodiment.

A concave portion 16 for covering (housing) a lower portion of the elastic member 15 is formed on the upper surface of the second insulating member 8*a* with which the lower portion of the elastic member 15 is in contact, and a receiving member 17 formed of metal (e.g., SUS, etc.) for preventing the second insulating member 8*a* formed of an insulating resin from being damaged by receiving the elastic member 15 is provided on a bottom of the concave portion 16 (i.e., a seat portion with which the lower portion of the elastic member 15 is in contact).

The receiving member 17 prevents damage of the second insulating member 8*a* by dispersing stress applied from the elastic member 15 to the upper surface of the second insulating member 8*a*. Therefore, a contact area between the receiving member 17 and the second insulating member 8*a* is preferably as large as possible. The receiving member 17 having a shape in contact throughout the entire bottom surface of the concave portion 16 is provided in the present embodiment in order to increase the contact area between the receiving member 17 and the second insulating member 8*a*.

The first terminal housing 5 is formed of a hollow cylindrical body 20 having a substantially rectangular shaped horizontal cross-section. An outer peripheral portion of one side (on the right side in FIG. 1A) of the cylindrical body 20 which is fitted to the second terminal housing 7 is formed in a tapered shape in light of fitting properties to the second connector portion 3. Meanwhile, a terminal housing waterproof structure 21 for sealing between the first connector portion 2 and the second connector portion 3 is provided on the outer peripheral portion of the one side of the cylindrical body 20. The terminal housing waterproof structure 21 is composed of a concave portion 22 formed on the outer peripheral portion of the one side of the cylindrical body 20 and a packing 23 such as an O-ring provided on the concave portion 22.

An assembly opening 20*a* which opens on one side of the cylindrical shape is formed inside the cylindrical body 20 on another side (on the left side in FIG. 1A), i.e., opposite to the side to be fitted to the second terminal housing 7. For assembling the first connector portion 2, the insulating member assembly 100 is inserted through the assembly opening 20*a* and is arranged in the first terminal housing 5 by respectively engaging the engagement portions 84 and 85 with the partition wall 86 and the base 87, and the resin molded body 10 is inserted through the assembly opening 20*a* and is fixed to the first terminal housing 5. Thus, the engagement portions 84 and 85 are sandwiched between and held by the first terminal housing 5 (the partition wall 86 and the base 87) and the resin molded body 10, thereby fixing the insulating member assembly 100 to the first terminal housing 5.

At this time, only a portion of the resin molded body 10 on the tip side in an insertion direction is housed in the first terminal housing 5 and the remaining portion protrudes outward from the first terminal housing 5. A packing 10*a* for preventing water from entering into the first terminal housing 5 is provided on the outer periphery of the tip portion (a portion housed in the first terminal housing 5) of the resin molded body 10. In addition, a non-illustrated non-packing airtight portion is formed on the resin molded body 10 on a cable insertion side to prevent water from trickling down through the cables 60*a* to 60*c* and entering into the first terminal housing 5.

A flange 24 for fixing the first connector portion 2 to a vehicle body, etc., is formed on the outer periphery of the other side of the cylindrical body 20. The flange 24 has a mounting hole 24*a* through which a non-illustrated bolt is inserted for fixation to the vehicle body, etc. Although the flange 24 provided on the first connector portion 2 is described in the present embodiment, the flange 24 may be provided on the second connector portion 3 or on both the first connector portion 2 and the second connector portion 3. Alternatively, the flange 24 may be omitted.

Meanwhile, the flange 24 is effective to improve heat dissipation. That is, a surface area of the first terminal housing 5 can be increased by forming the flange 24, and it is thus possible to improve the heat dissipation when heat generated inside the first connector portion 2 (e.g., heat generated at each contact point) is released to the outside through the first terminal housing 5.

A connecting member insertion hole 26 for inserting the connecting member 9 therethrough is formed on the upper portion (on the upper side in FIG. 1A) of the cylindrical body 20. A portion of the first terminal housing 5 as a periphery of the connecting member insertion hole 26 is formed in a cylindrical shape (a hollow cylindrical shape).

For shielding performance, heat dissipation and weight saving of the connector 1, the cylindrical body 20 is preferably formed of light metal having high electrical and thermal conductivity such as aluminum, but may be formed of resin, etc. In the present embodiment, the cylindrical body 20 is formed of aluminum.

Second Connector Portion

Next, the second connector portion 3 will be described.

As shown in FIGS. 1A to 2B, the second connector portion 3 has the second terminal housing 7 in which plural (three) aligned second connecting terminals (female terminals) 6*a* to 6*c* are housed.

The cables 61*a* to 61*c* extending from the inverter side are respectively connected to edges of the second connecting terminals 6*a* to 6*c* on one side. The cables 61*a* to 61*c* are respectively electrically connected to the cables 60*a* to 60*c* via the first connecting terminals 4*a* to 4*c* and the second connecting terminals 6*a* to 6*c*, and electricity of different voltage and/or current corresponding to each of the cables 60*a* to 60*c* is transmitted. The cables 61*a* to 61*c* are the same cables as the cables 60*a* to 60*c* and are each composed of the conductor 62 and the insulation layer 63 formed on the outer periphery thereof. Although the same cables as the cables 60*a* to 60*c* are used as the cables 61*a* to 61*c*, cables having different sizes may be used.

The cables 61*a* to 61*c* are each aligned and held at predetermined intervals by a resin molded body (inner housing) 30 which is in a multi-cylindrical shape. The resin molded body 30 positions and holds the second connecting terminals 6*a* to 6*c* respectively on the first connecting terminals 4*a* to 4*c* (i.e., objects to be connected) which face the second connecting terminals 6*a* to 6*c* to be respectively paired therewith when the first connector portion 2 is fitted to the second connector portion 3.

The resin molded body 30 is formed of an insulating resin, etc., to prevent short circuit by insulating the second connecting terminals 6*a* to 6*c* from each other. The resin molded body 30 allows the second connecting terminals 6*a* to 6*c* to be held at respective predetermined positions even though each of the cables 61*a* to 61*c* respectively connected to the second connecting terminals 6*a* to 6*c* is very flexible.

Although the resin molded body 30 positions the second connecting terminals 6*a* to 6*c* by holding the cables 61*a* to 61*c*, it is not limited thereto. The resin molded body 30 may directly hold and position the second connecting terminals 6*a* to 6*c* while holding the cables 61*a* to 61*c*. Alternatively, a connecting terminal holding member for directly holding the second connecting terminals 6*a* to 6*c* without holding the cables 61*a* to 61*c* may be used.

In a case that the resin molded body 30 positions the second connecting terminals 6*a* to 6*c* by holding the cables 61*a* to 61*c* without directly holding the second connecting terminals 6*a* to 6*c*, i.e., in the case as is the present embodiment, use of flexible cables 61*a* to 61*c* allows the tips of the second connecting terminals 6*a* to 6*c* to flexibly move with respect to the second terminal housing 7, and it is thereby possible to suppress deformation of the second connecting terminals 6*a* to 6*c* caused by pressure from the connecting member 9.

In addition, a non-illustrated braided shield is wound around portions of the cables 61*a* to 61*c* which are out of the second terminal housing 7, in order to improve the shielding performance. The braided shield is in contact with a below-described cylindrical shield body 41, and is electrically connected to the first terminal housing 5 via the cylindrical shield body 41 (the same potential (GND)).

Similarly to the first connector portion 2, the second connector portion 3 is provided with a slip-off preventing mechanism 27 so that the cables 61*a* to 61*c* are not pulled out from the resin molded body 30 even when the cables 61*a* to 61*c* are pulled. The slip-off preventing mechanism 27 is composed of a protrusion 27*a* each formed at the proximal ends of the second connecting terminals 6*a* to 6*c* (in the vicinity of the cables 61*a* to 61*c*) and a locking projection 27*b* which is provided in each cylinder of the multi-cylindrical resin molded body 30 in a protruding manner to restrict backward movement (toward the right side in FIG. 1A) of the protrusion 27*a* by locking with the protrusion 27*a*.

As shown in FIGS. 5A to 6B, each of the second connecting terminals 6*a* to 6*c* has a caulking portion 45 for caulking the conductor 62 which is exposed at a tip portion of the cables 61*a* to 61*c* and a plate-like contact point 46 integrally formed with the caulking portion 45. In addition, a trunk portion 47 of the second connecting terminal 6*b* connected to the cable 61*b* which is arranged in the middle when aligned is bent so that the second connecting terminals 6*a* to 6*c* are arranged at equal intervals. The protrusion 27*a* of the slip-off preventing mechanism 27 is formed to protrude upward (downward) from both widthwise end portions of the plate-like contact point 46 at the proximal end thereof.

Each of the second connecting terminals 6*a* to 6*c* should be formed of a highly conductive metal such as silver, copper or aluminum to reduce transmission loss, etc., in the connector 1. In addition, each of the second connecting terminals 6*a* to 6*c* has little flexibility.

The second terminal housing 7 is composed of a hollow cylindrical body 36 having a substantially rectangular horizontal cross section. Since the first terminal housing 5 is fitted in the second terminal housing 7, an inner peripheral portion of the cylindrical body 36 on one side (on the left side in FIG. 1A) to be fitted to the first terminal housing 5 is formed in a tapered shape in light of fitting properties to the first terminal housing 5.

The resin molded body 30 aligning and holding the cables 61*a* to 61*c* is housed in the cylindrical body 36 on the other end side (on the right side in FIG. 1A). A non-packing airtight portion 43 is provided on the resin molded body 30 on a cable insertion side to prevent water from trickling down through the cables 61*a* to 61*c* and entering into the second terminal housing 7. A packing 44 in contact with the resin molded body 30 is provided on the outer periphery of the non-packing airtight portion 43.

In addition, a packing 38 in contact with an inner peripheral surface of the first terminal housing 5 is provided on the outer peripheral portion of the resin molded body 30. That is, the connector 1 has a double waterproof structure composed of the packing 23 of the terminal housing waterproof structure 21 and the packing 38 provided on the outer peripheral portion of the resin molded body 30.

Furthermore, the outer periphery of the cylindrical body 36 on the other end side from where the cables 61*a* to 61*c* are led out is covered by a rubber boot for preventing water from entering into the cylindrical body 36, even though it is not illustrated.

Meanwhile, a connecting member manipulating hole 40, through which the connecting member 9 provided on the first connector portion 2 is manipulated when the second connector portion 3 is fitted to the first connector portion 2, is formed on an upper portion of the cylindrical body 36 (on the upper side in FIG. 1A).

For shielding performance, heat dissipation and weight saving of the connector 1, the cylindrical body 36 is preferably formed of light metal having high electrical and thermal conductivity such as aluminum, but may be formed of resin, etc. Since the cylindrical body 36 is formed of an insulating resin in the present embodiment, the aluminum cylindrical shield body 41 is provided on an inner peripheral surface of the cylindrical body 36 on the other end side in order to improve the shielding performance and the heat dissipation.

The cylindrical shield body 41 has a contact portion 42 which comes in contact with an outer periphery of the aluminum first terminal housing 5 when the first connector portion 2 is fitted to the second connector portion 3, and the cylindrical shield body 41 and the first terminal housing 5 are thermally and electrically connected via the contact portion 42. This improves the shielding performance and the heat dissipation. Significant improvement is expected particularly in the heat dissipation by actively releasing heat to the first terminal housing 5 which is excellent in heat dissipation.

Connection Between First Connector Portion 2 and Second Connector Portion 3

When the two terminal housings 5 and 7 are fitted to each other, the second connecting terminals 6*a* to 6*c* are respectively inserted into gaps between the respective pairs of the first connecting terminals 4*a* to 4*c* and the insulating members 8*a* to 8*d*. The insertion provides a laminated structure in which the surfaces of the plural first connecting terminals 4*a* to 4*c* on the one side face the surfaces of the plural second connecting terminals 6*a* to 6*c* on the one side to form the respective pair, and the first connecting terminals 4*a* to 4*c*, the second connecting terminals 6*a* to 6*c* and the insulating members 8*a* to 8*d* are alternately arranged, i.e., the insulating members 8*a* to 8*d* are arranged so as to sandwich the pairs of the first connecting terminals 4*a* to 4*c* and the second connecting terminals 6*a* to 6*c*.

At this time, in the first connector portion 2, since the first insulating members 8*b* to 8*d* are respectively fixed to the tip of the first connecting terminals 4*a* to 4*c* aligned and held at predetermined intervals, each gap between the insulating members 8*b* to 8*d* can be kept without additionally providing a retaining jig for keeping gaps between the respective insulating members 8*b* to 8*d* (see Japanese patent No. 4037199). This makes easy to insert the second connecting terminals 6*a* to 6*c* into the gaps between the respective pairs of the first connecting terminals 4*a* to 4*c* and the insulating members 8*a* to 8*d*. In other words, the insertion and extraction properties of the second connecting terminals 6*a* to 6*c* are not degraded. In addition, it is very effective in that it is possible to realize further downsizing as compared to the conventional art since it is not necessary to provide a retaining jig for keeping the gaps between the insulating members 8*b* to 8*d*.

Meanwhile, a contact point between the first connecting terminal 4*a* and the second connecting terminal 6*a* is sandwiched between the second insulating member 8*a* and the first insulating member 8*b* fixed to the first connecting terminal 4*a* constituting the contact point. Likewise, a contact point between the first connecting terminal 4*b* (or 4*c*) and the second connecting terminal 6*b* (or 6*c*) is sandwiched between the first insulating member 8*c* (or 8*d*) fixed to the first connecting terminal 4*b* (or 4*c*) constituting the contact point and the first insulating member 8*b* (or 8*c*) fixed to the first connecting terminal 4*a* (or 4*b*) constituting another contact point.

When the pressing portion 92 of the connecting member 9 is turned by a tool such as wrench in this state and is pressed downward, the second insulating member 8*a*, the first insulating member 8*b*, the first insulating member 8*c* and the first insulating member 8*d* are pressed in this order by the elastic member 15, a pressing force is imparted to each contact point by any two of the insulating members 8*a* to 8*d* sandwiching and pressing each contact point, and each contact point comes in contact in a state of being insulated from each other. At this time, the first connecting terminals 4*a* to 4*c* and the second connecting terminals 6*a* to 6*c* are bent in some degree due to pressure from the insulating members 8*a* to 8*d* and respectively make contact in a large area. This makes strong contact and fixation of each contact point even under the environment in which vibration occurs, such as in a vehicle.

Connecting Member

Next, the connecting member 9 which is an essential portion of the invention will be described.

As shown in FIG. 1B, the connecting member 9 has a ring-shaped support 91 fixed to the first terminal housing 5 and a pressing portion 92 of which upper portion is inserted into a hollow formed inside the ring-shaped support 91 so as to be pivotably supported thereby.

Firstly, the support 91 will be described.

The support 91 has a ring-shaped frame 93 fixed to the first terminal housing 5 and a sliding protrusion 94 protruding downward (toward the second insulating member 8*a*) from the frame 93. In the present embodiment, two sliding protrusions 94 are formed so as to each protrude downward from opposite positions on the frame 93. In this regard, however, the number of the sliding protrusions 94 is not limited thereto, and one or three or more sliding protrusions 94 may be formed.

The sliding protrusions 94 is formed in an arc shape in a top view so as to be along the ring-shaped frame 93. In addition, corners of the lower edge of the sliding protrusions 94 are chamfered (rounded) so as to easily slide along a stepped surface 97*a* of a below-described sliding receiving portion 97. Forming the sliding protrusions 94 in an arc shape in a top view allows strength against a vertical load to be improved as compared to the case of forming the sliding protrusions 94 into a straight shape in a top view. This results in allowing the sliding protrusions 94 to be thin, and contributes to downsize the entire connecting member 9.

An engagement portion 95 for engaging the frame 93 with the first terminal housing 5 is formed on the sliding protrusions 94. The engagement portion 95 is a rectangular protrusion in a front view, which is formed to protrude outward (outward in a radial direction of the frame 93) from the side surface (outer peripheral surface) of the sliding protrusions 94. The support 91 is fixed to the first terminal housing 5 by engaging the engagement portion 95 with an engaging groove (not shown) formed on an inner peripheral surface of the connecting member insertion hole 26. The engagement portion 95 also serves as a whirl-stop which restricts the support 91 so as not to rotate with the turning of the pressing portion 92.

Although the engagement portion 95 is formed on the sliding protrusions 94 here, it is not limited thereto and the engagement portion 95 may be formed on the side surface (outer peripheral surface) of the frame 93 excluding the sliding protrusions 94. However, considering the contact between the engagement portion 95 and the stepped portion 98*a*, the thickness (thickness in a vertical direction) of the support 91 (the frame 93 and the sliding protrusions 94) in this case is greater than the case where the engagement portion 95 is formed on the sliding protrusions 94, and the entire connecting member 9 may become large in size. That is, forming the engagement portion 95 on the sliding protrusions 94 allows the support 91 to be thin, and contributes to downsize the entire connecting member 9.

Meanwhile, although here is a case that the engagement portion 95 as a protrusion is formed on the support 91 and the engaging groove is formed on the first terminal housing 5, the positions of the protrusion and the groove may be reversed. That is, it may be configured such that a protruding engagement portion is formed on the first terminal housing 5 (on the inner peripheral surface of the connecting member insertion hole 26) and the engaging groove for engaging the engagement portion is formed on the sliding protrusions 94.

A stopper 93*b* which slightly protrudes inward in a radial direction from the inner peripheral surface of the frame 93 is formed on the frame 93 at a position where the sliding protrusions 94 is formed. The stopper 93*b* restricts a rotation range of a below-described rib 96*c*.

Next, the pressing portion 92 will be described.

The pressing portion 92 is formed in a substantially columnar shape, and has a main body 96 of which upper portion is inserted into a hollow 93*a* formed inside the ring-shaped frame 93 and of which lower portion presses the second insulating member 8*a* adjacent thereto (i.e., presses toward the contact points), and a sliding receiving portion 97 as a stepped portion formed circumferentially on the side surface of the columnar main body 96 and having a stepped surface 97*a* on top thereof.

The main body 96 is formed to have a diameter slightly smaller than the inner diameter of the frame 93, and is composed of a small diameter portion 96*a* inserted into the hollow 93*a* of the frame 93 and a large diameter portion 96*b* integrally formed with a lower portion of the small diameter portion 96*a* and having a diameter substantially the same as the outer diameter of the frame 93. A stepped portion formed between the small diameter portion 96*a* and the large diameter portion 96*b* is the sliding receiving portion 97.

A convex rib 96*c* is formed on the side surface (outer peripheral surface) of the small diameter portion 96*a* at opposite positions so as to extend in a vertical direction, and a gap with a predetermined distance is formed between the frame 93 and the small diameter portion 96*a* by contact between the rib 96*c* and the inner peripheral surface of the frame 93. It is possible to reduce a contact area between the main body 96 and the frame 93 by forming the rib 96*c*, which allows smooth turning of the main body 96 relative to the frame 93. In addition, the rib 96*c* is configured not to move (turn) over the stopper 93*b*, and serves to restrict a turning range of the main body 96.

A groove 96*d* is formed along a circumferential direction below the large diameter portion 96*b* of the main body 96, and a packing 14 for preventing water from entering into the first terminal housing 5 is provided in the groove 96*d* (the packing 14 is omitted in FIG. 1B).

The sliding receiving portion 97 restricts the upward movement of the main body 96 relative to the frame 93 by contacting the lower edge of the sliding protrusion 94 with the stepped surface 97*a*, thereby positioning in the vertical direction the pressing portion 92 relative to the support 91. Since a force is constantly applied upward to the main body 96 by the elastic member 15, the main body 96 is automatically positioned in the vertical direction when the upward movement of the main body 96 is restricted.

The connector 1 in the present embodiment is configured such that the pressing portion 92 moves in the vertical direction relative to the support 91 with the turning of the pressing portion 92 by changing the vertical position of the stepped surface 97*a* of the sliding receiving portion 97 in a circumferential direction of the main body 96.

In detail, the sliding receiving portion 97 has a first horizontal portion 97*b* formed perpendicular to the vertical direction (referred to as a horizontal direction), a slope 97*c* formed to extend diagonally downward (diagonally downward left in the drawing) along the side surface of the main body 96 from an edge of the first horizontal portion 97*b* (an edge on the left side in the drawing) and a second horizontal portion 97*d* horizontally formed from an edge of the slope 97*c* (an edge on the left side in the drawing). That is, the sliding receiving portion 97 is configured such that the first horizontal portion 97*b* and the second horizontal portion 97*d*, which are formed at vertically different positions, are moderately connected by the slope 97*c*.

In the present embodiment, since the two sliding protrusions 94 are formed at the opposite positions, the first horizontal portions 97*b*, the slopes 97*c* and the first horizontal portions 97*b* which constitute the sliding receiving portion 97 are formed, two for each, at opposite positions so as to correspond the two sliding protrusions 94. At this time, the first horizontal portion 97*b* is adjacent to the second horizontal portion 97*d*, however, since the second horizontal portion 97*d* is formed at a lower position than the first horizontal portion 97*b*, the vertical stepped portion 98*a* is formed therebetween. The stepped portion 98*a* serves to restrict the sliding protrusion 94 so as not to move (turn) to the left of the second horizontal portion 97*d*.

In addition, a protrusion 98*b* protruding upward from the stepped surface 97*a* is formed at an edge of the first horizontal portions 97*b* on the second horizontal portion 97*d* side (an edge on the right in the drawing), i.e., at the upper portion of the stepped portion 98*a*. The protrusion 98*b* restricts the sliding protrusion 94 so as not to move (turn) to the right of the first horizontal portion 97*b*. A vertical length from the lower edge of the stepped portion 98*a* to the upper edge of the protrusion 98*b* (i.e., a vertical length from the second horizontal portion 97*d* to the upper surface of the protrusion 98*b*) is substantially equal to a vertical length of the sliding protrusion 94 (i.e., a vertical length from the lower edge of the sliding protrusion 94 to the lower surface of the frame 93).

The rib 96*c* is formed to extend upward from the protrusion 98*b*, and is configured to come into contact with the stopper 93*b* at the same time that the sliding protrusion 94 comes into contact with the protrusion 98*b*. Additionally, the rib 96*c* comes into contact with the stopper 93*b* at the same time that the sliding protrusion 94 comes into contact with the stepped portion 98*a*.

A protrusion supporting portion 99 in a recessed shape for housing the lower edge of the sliding protrusion 94 is formed on the first horizontal portion 97*b* (as the stepped surface 97*a* on the left of the protrusion 98*b*). The protrusion supporting portion 99 prevents application of the pressing force to each contact point from being released due to unintentional turning of the main body 96 caused by vibration, etc. The protrusion 98*b* is configured to come into contact with a right edge of the sliding protrusion 94 when the lower edge of the sliding protrusion 94 is housed in the protrusion supporting portion 99.

In addition, by forming the protrusion supporting portion 99, vibration (or change in an operational feeling) at the time of fitting the sliding protrusion 94 to the protrusion supporting portion 99 is transmitted to a hand of a worker who is operating a tool such as a wrench, which makes the worker feel that the sliding protrusion 94 is fitted to the protrusion supporting portion 99, i.e., the pressing portion 92 is turned to a position not allowing further turning. That is, the protrusion supporting portion 99 serves to inform the worker that the pressing portion 92 is sufficiently turned and to prevent the worker from excessively turning the pressing portion 92.

It is desirable that the support 91 and the pressing portion 92 of the connecting member 9 be formed of a metal-based material such as SUS from the viewpoint of durability and mechanical strength.

Next, the specific turning movement of the connecting member 9 will be described in reference to FIGS. 7 to 10. Note that, the first terminal housing 5 and the second terminal housing 7 are indicated by a dashed line in FIGS. 7C, 8C, 9C and 10C.

Figure 7A:
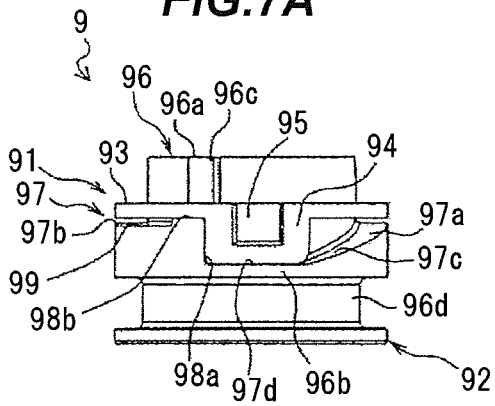
Figure 7B:
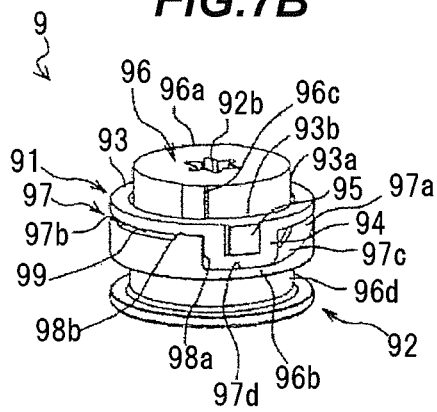
Figure 7C:
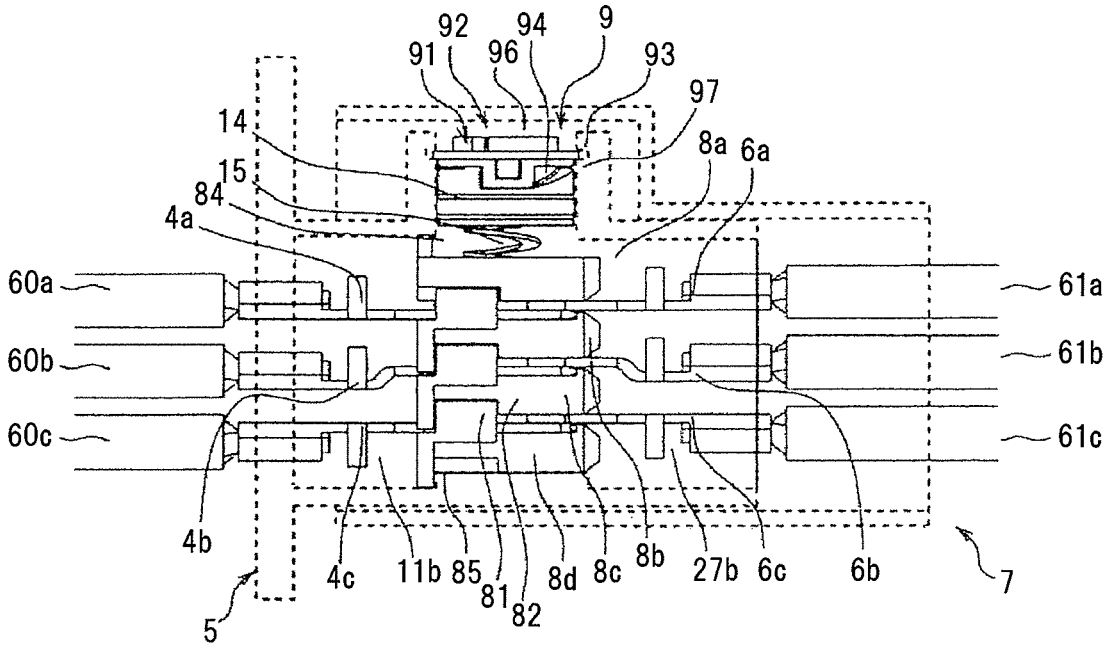

As shown in FIGS. 7A to 7C, the pressing portion 92 is initially turned to the left in a top view (counterclockwise) relative to the support 91 to position the sliding protrusion 94 on the second horizontal portion 97*d*. At this time, the stepped portion 98*a* restricts the sliding protrusion 94 so as not to move (turn) to the left in the drawing, thereby preventing the pressing portion 92 from being excessively turned.

In the state that the pressing portion 92 is positioned on the second horizontal portion 97*d*, the main body 96 of the pressing portion 92 is moved to the uppermost position (the opposite side to the second insulating member 8*a*) and a pressing force by the main body 96 hardly acts on the second insulating member 8*a*. The first terminal housing 5 is fitted to the second terminal housing 7 in this state and the second connecting terminals 6*a* to 6*c* are inserted into gaps between the first connecting terminals 4*a* to 4*c* and the insulating members 8*a* to 8*c* facing thereto.

Figure 8A:
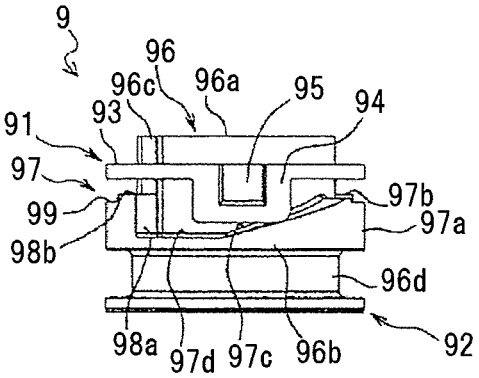
Figure 8B:
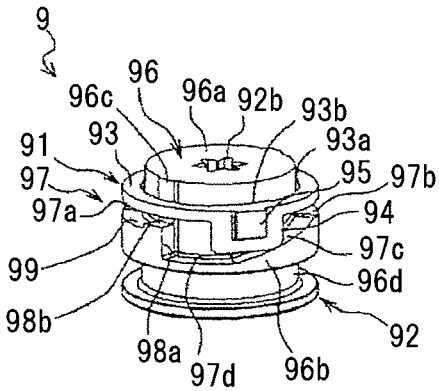
Figure 8C:
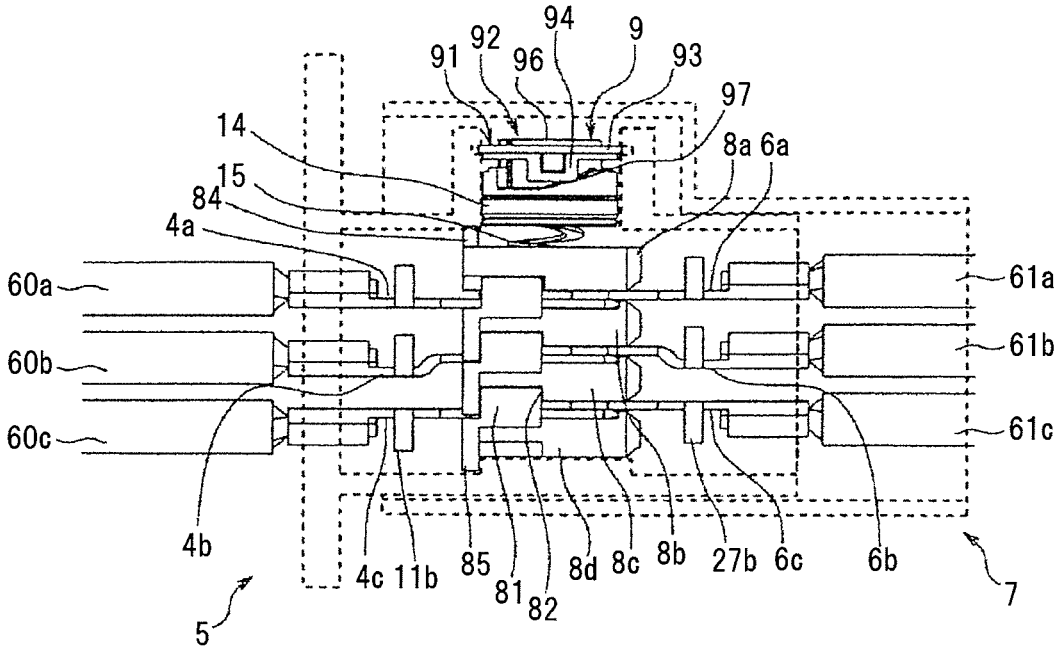

After that, the pressing portion 92 is turned to the right in a top view (clockwise) relative to the support 91 as shown in FIGS. 8A to 8C. Accordingly, the sliding protrusion 94 slides along the stepped surface 97*a* of the sliding receiving portion 97 and climbs up the slope 97*c*, the main body 96 of the pressing portion 92 which is gradually pressed down against a spring force of the elastic member 15 presses the adjacent second insulating member 8*a* via the elastic member 15, and the pressing force is thereby gradually applied to each contact point.

Figure 9A:
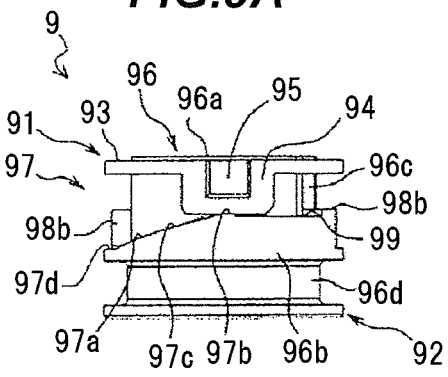
Figure 9B:
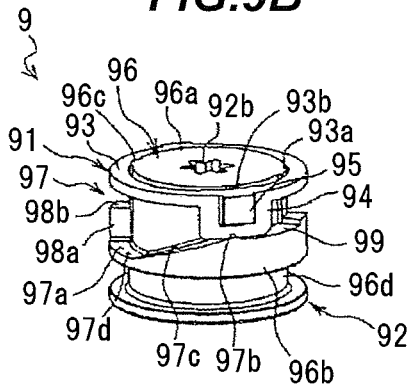
Figure 9C:
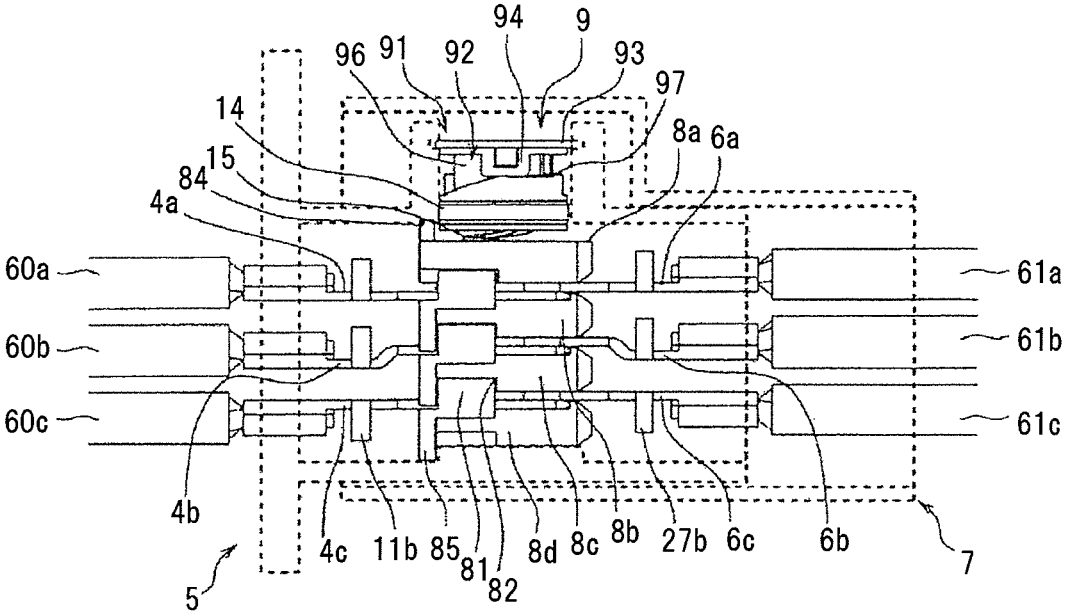

When the pressing portion 92 is further turned, the sliding protrusion 94 climbs over the first horizontal portion 97*b*, as shown in FIGS. 9A to 9C. The main body 96 of the pressing portion 92 is moved to the lowermost position (on the second insulating member 8*a* side) at this stage, thereby becoming a state in which a sufficient pressing force is applied to each contact point.

Figure 10A:
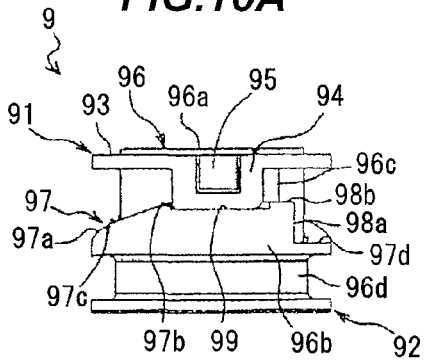
Figure 10B:
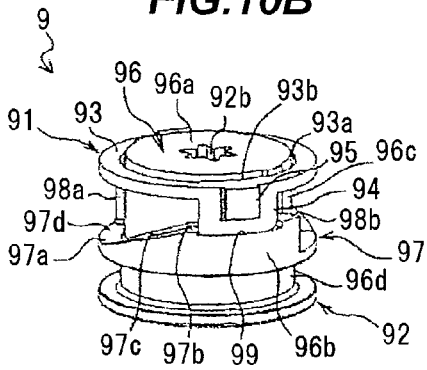
Figure 10C:
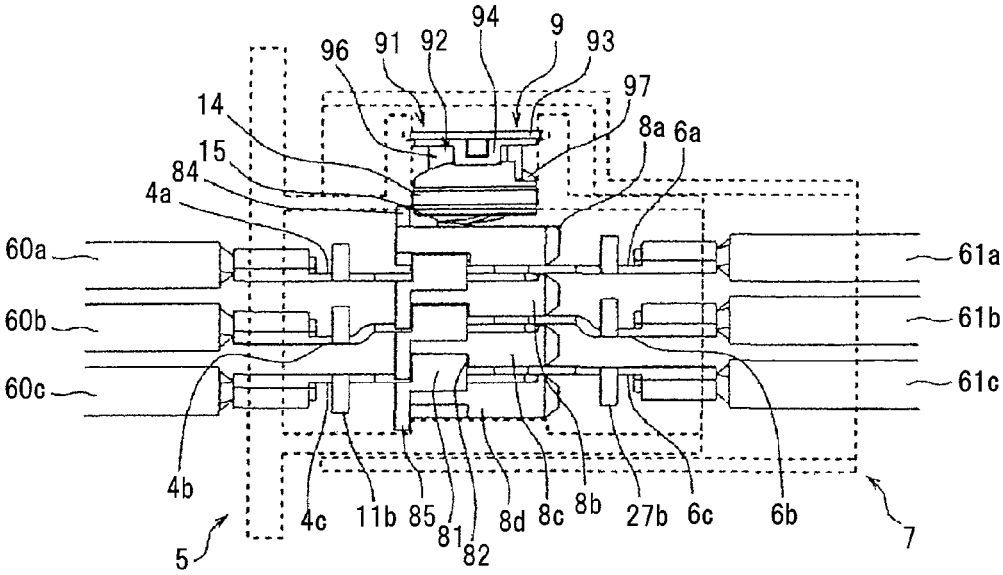

When the pressing portion 92 is still further turned, the sliding protrusion 94 is housed in the protrusion supporting portion 99 as shown in FIGS. 10A to 10C. Since vibration (or change in an operational feeling) is transmitted to a hand of a worker who is operating a tool such as a wrench when the sliding protrusion 94 is fitted to the protrusion supporting portion 99, the worker finishes turning at the point that he (she) feels the vibration (or the change in an operational feeling). Meanwhile, when the sliding protrusion 94 is housed in the protrusion supporting portion 99, the movement (turning) of the sliding protrusion 94 to the right in the drawing is restricted by the protrusion 98*b* and the pressing portion 92 is prevented from excessively moving.

Effects of the Present Embodiment

The effects of the present embodiment will be described.

In the connector 1 of the present embodiment, the connecting member 9 has a ring-shaped support 91 fixed to the first terminal housing 5 and a pressing portion 92 of which upper portion is inserted into a hollow formed inside the ring-shaped support 91 so as to be pivotably supported thereby, and the connecting member 9 is configured such that the pressing portion 92 is turned relative to the support 91 by turning the upper portion of the pressing portion 92, vertically moves relative to the support 91 with the turning, and then presses the adjacent second insulating member 8*a*.

In the connector 1, since the pressing portion 92 to be turned is supported by the support 91, the first terminal housing 5 is not ground by the turning movement of the pressing portion 92, which allows light aluminum to be used for the first terminal housing 5.

In addition, since the support 91 and the pressing portion 92 are members different from the first terminal housing 5, it is possible to form the support 91 and the pressing portion 92 using a material different from that constituting first terminal housing 5. Therefore, it is possible to improve durability and mechanical strength of the turning portions by forming the support 91 and the pressing portion 92 from a material such as SUS.

In other words, according to the invention, it is possible to improve durability of a turn mechanism which turns the connecting member 9. As a result, it is possible to configure to press each contact point via the elastic member 15 and to realize the connector 1 suitable for a vehicle which is light and less susceptible to vibration.

In addition, the connector 1 is configured such that the sliding protrusion 94 formed on the support 91 so as to protrude downward from the frame 93 and the sliding receiving portion 97 formed on the side surface of the main body 96 of the pressing portion 92 along a circumferential direction restrict the vertical movement of the main body 96 by contacting the lower edge of the sliding protrusions 94 with the stepped surface 97*a* of the sliding receiving portion 97 to position in the vertical direction the pressing portion 92 relative to the support 91, and the pressing portion 92 is vertically moved relative to the support 91 with the turning of the pressing portion 92 by changing the vertical position of the stepped surface 97*a* of the sliding receiving portion 97 in a circumferential direction of the main body 96.

Such a configuration allows the connecting member 9 to have a simple shape as compared to the case of, e.g., screwing a screw thread with a screw groove, and it is possible to realize a high durable connecting member 9 by reducing influence of abrasion caused by repeated turning movement, thereby improving reliability of the connector 1.

In addition, in the connector 1, the sliding receiving portion 97 has the first horizontal portion 97*b* formed in a horizontal direction and the slope 97*c* formed to extend diagonally upward along the side surface of the main body 96 from the edge of the first horizontal portion 97*b*, and the protrusion supporting portion 99 in a recessed shape for housing the lower edge of the sliding protrusion 94 is formed on the first horizontal portion 97*b*.

By forming the protrusion supporting portion 99 on the first horizontal portion 97*b*, it is possible to prevent application of the pressing force to each contact point from being released due to unintentional turning of the pressing portion 92 (the main body 96) and movement thereof toward the slope 97*c*, in addition, since vibration (or change in an operational feeling) at the time of fitting the sliding protrusion 94 to the protrusion supporting portion 99 is transmitted to a hand of a worker who is operating a tool such as a wrench, it is possible to inform the worker that the pressing portion 92 is sufficiently turned and to prevent the worker from excessively turning the pressing portion 92.

Furthermore, in the connector 1, since the engagement portion 95 for engaging the frame 93 with the first terminal housing 5 is formed on the sliding protrusions 94, it is possible to reduce the thickness of the frame 93 and to downsize the entire connecting member 9.

It should be noted that the present invention is not intended to be limited to the embodiment, and the various changes can be made without departing from the gist of the present invention.

Figure 11A:
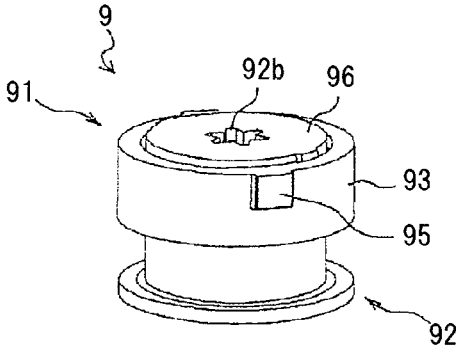
Figure 11B:
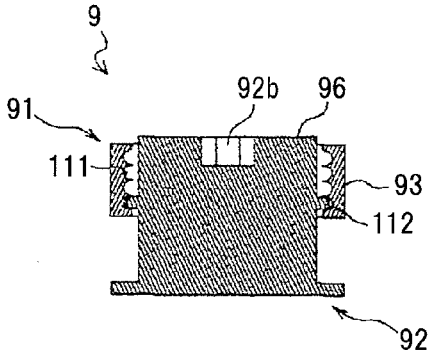

For example, although the embodiment is configured such that the pressing portion 92 is vertically moved relative to the support 91 with the turning of the pressing portion 92 by moving the sliding protrusions 94 along the stepped surface 97*a* of the sliding receiving portion 97, the structure of vertically moving the pressing portion 92 relative to the support 91 with the turning of the pressing portion 92 is not limited thereto, and for example, it may be configured such that a helical groove (or screw groove) 111 is formed on an inner peripheral surface of the frame 93 of the support 91, protrusions (or screw threads) 112 protruding outward in a radial direction from the opposite positions are formed on the outer periphery of the main body 96 of the pressing portion 92 and the protrusion 112 is screwed with the helical groove 111, as shown in FIGS. 11A and 11B. Alternatively, the positions of the sliding protrusions 94 and the sliding receiving portion 97 may be reversed such that a protrusion is formed on the pressing portion 92 side (on the side surface of the main body 96) and a slope-shaped receiving portion for guiding the protrusion is formed on the support 91 side.

In addition, the embodiment assumes the use of a three-phase AC power line, however, according to the technical idea of the invention, it may be, e.g., a connector for a vehicle which is configured to collectively connect lines used for different purposes such as a three-phase AC power line between a motor and an inverter and a two-phase DC power line for air conditioner. Since the configuration described above allows one connector to collectively connect power lines used for different purposes, it is not necessary to prepare different connectors for each intended purpose and it is thus possible to contribute to space saving and cost reduction.

Alternatively, surfaces of the first connecting terminals 4*a* to 4*c* and of the second connecting terminals 6*a* to 6*c* may be each roughened by a knurling process to increase frictional force so as to make the terminals difficult to move, thereby strengthening the fixation at each contact point.

Although the first connecting terminals 4*a* to 4*c* provided at the end portions of the cables 60*a* to 60*c* have been described in the embodiment, it is not limited thereto. The first connecting terminals 4*a* to 4*c* may be a bus bar, etc., to which a cable is not connected.

In addition, although the case where the first insulating members 8*b* to 8*d* are fixed to the first connecting terminals 4*a* to 4*c* by fitting the first connecting terminals 4*a* to 4*c* to the fitting grooves 83 has been described in the embodiment, the first insulating members 8*b* to 8*d* may be fixed to the first connecting terminals 4*a* to 4*c* by insert molding or by press-fitting the first connecting terminals 4*a* to 4*c* into the first insulating members 8*b* to 8*d*.

In addition, although a cable excellent in flexibility is used as the cables 60*a* to 60*c* and 61*a* to 61*c* in the embodiment, a rigid cable may be used.

In addition, in the embodiment, a direction of the connecting member 9 may be either substantially horizontal or substantially vertical when the connector is in use. In other words, a direction in a usage state is not a requirement in the use conditions of the connector of the present embodiment.

In addition, although the main body 96 of the pressing portion 92 presses the second insulating member 8*a* adjacent thereto via the elastic member 15 which is a portion of the connecting member 9 in the embodiment, the adjacent second insulating member 8*a* may be pressed directly by the main body 96, not via the elastic member 15.

In addition, although the case of providing the connecting member 9 on only one side of the first terminal housing 5 has been described in the embodiment, the connecting member 9 may be provided on both sides of the first terminal housing 5 so that a pressing force is imparted to each contact point by the two connecting members 9 provided on the both sides.

In addition, although the main body 96 of the pressing portion 92 is formed in a substantially cylindrical shape in the embodiment, a shaft penetrating through each contact point may be integrally formed with the main body 96 so as to be a through type.

In addition, although the case where the insulating members 8*a* to 8*d* are housed in the first terminal housing 5 has been described in the embodiment, it may be configured such that, e.g., the insulating members 8*b* to 8*d* are housed in the second terminal housing 7.

In addition, the connecting member 9 in the embodiment is configured such that the upper portion of the column-shaped main body 96 of the pressing portion 92 is inserted into the hollow formed inside the ring-shaped frame 93 of the support 91, i.e., the upper portion of the column-shaped main body 96 fits with the hollow in the frame 93 as shown in FIG. 1B, however, other configurations are possible without departing from the gist of the invention. That is, it may be configured such that the upper portion of the column-shaped main body 96 does not fit with the hollow in the frame 93 (the upper portion of the column-shaped main body 96 of the pressing portion 92 is not inserted into the hollow formed inside the ring-shaped frame 93 of the support 91). In this configuration, the hollow in the frame 93 needs to have a size at least such that the irregular-shaped hole 92*b* is completely visible from the outside.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A connector, comprising:

a first terminal housing for housing a plurality of first connecting terminals aligned;

a second terminal housing for housing a plurality of second connecting terminals aligned;

a plurality of insulating members;

a laminated structure formed where one surface of the plurality of first connecting terminals faces one surface of the plurality of second connecting terminals to form pairs and to form a plurality of contact points sandwiched between the plurality of insulating members when the first terminal housing is fitted to the second terminal housing; and a connecting member for collectively fixing and electrically connecting the plurality of first connecting terminals and the plurality of second connecting terminals at each contact point by pressing the plurality of first connecting terminals and the plurality of second connecting terminals, wherein the connecting member comprises a ring-shaped support fixed to the first terminal housing and a pressing portion an upper part of which is inserted into a hollow formed inside the ring-shaped support so as to be pivotally supported by the support, wherein one of the support and the pressing portion comprises a sliding protrusion, and the other comprises a sliding receiving portion comprising a stepped portion having a stepped surface to contact the sliding protrusion, for positioning the pressing portion relative to the support in a vertical direction by contacting the sliding protrusion with the stepped surface, and wherein the pressing portion is configured to move relative to the support with the turning of the pressing portion in the vertical direction by changing a vertical position of the stepped surface of the sliding receiving portion in a circumferential direction.

2. The connector according to claim 1, wherein the support comprises a ring-shaped frame fixed to the first terminal housing and the sliding protrusion, wherein the pressing portion comprises a columnar main body, a lower part thereof being pressed toward the plurality of contact points, and the sliding receiving portion, wherein the sliding protrusion protrudes downward from the frame, wherein the sliding receiving portion comprises a stepped portion formed circumferentially on a side surface of the columnar main body and having a stepped surface on top thereof so as to restrict upward movement of the main body relative to the frame by contacting a lower end of the sliding protrusion with the stepped surface to position the pressing portion relative to the support in the vertical direction, and wherein the pressing portion is configured to move relative to the support in the vertical direction with the turning of the pressing portion by changing a vertical position of the stepped surface of the sliding receiving portion in a circumferential direction of the main body.

3. The connector according to claim 1, wherein the support comprises a ring-shaped frame fixed to the first terminal housing and the sliding protrusion, wherein the pressing portion comprises a columnar main body, an upper part of the columnar main body being inserted into a hollow formed inside the frame and a lower part thereof being pressed toward the plurality of contact points, and the sliding receiving portion, wherein the sliding protrusion protrudes downward from the frame, wherein the sliding receiving portion comprises a stepped portion formed circumferentially on a side surface of the columnar main body and having a stepped surface on top thereof so as to restrict upward movement of the main body relative to the frame by contacting a lower end of the sliding protrusion with the stepped surface to position the pressing portion relative to the support in the vertical direction, and wherein the pressing portion is configured to move relative to the support in the vertical direction with the turning of the pressing portion by changing a vertical position of the stepped surface of the sliding receiving portion in a circumferential direction of the main body.

4. The connector according to claim 3, wherein the sliding protrusion comprises an engagement portion for engaging the frame with the first terminal housing.

5. The connector according to claim 3, wherein the sliding receiving portion comprises a horizontal portion formed perpendicular to the vertical direction, and a slope formed to extend diagonally downward along the side surface of the main body from an end of the first horizontal portion.

6. The connector according to claim 5, wherein the first horizontal portion comprises a concave protrusion supporting portion for housing the lower end of the sliding protrusion.

7. A connector, comprising:

a first terminal housing for housing a plurality of first connecting terminals aligned;

a second terminal housing for housing a plurality of second connecting terminals aligned;

a plurality of insulating members;

a laminated structure formed where one surface of the plurality of first connecting terminals faces one surface of the plurality of second connecting terminals to form pairs and to form a plurality of contact points sandwiched between the plurality of insulating members when the first terminal housing is fitted to the second terminal housing; and a connecting member for collectively fixing and electrically connecting the plurality of first connecting terminals and the plurality of second connecting terminals at each contact point by pressing the plurality of first connecting terminals and the plurality of second connecting terminals, wherein the connecting member comprises a ring-shaped support fixed to the first terminal housing and a pressing portion an upper part of which is inserted into a hollow formed inside the ring-shaped support so as to be pivotally supported by the support, wherein the support comprises a ring-shaped frame fixed to the first terminal housing and a sliding protrusion protruding downward from the frame, wherein the pressing portion comprises a columnar main body, an upper part of the columnar main body being inserted into a hollow formed inside the frame and a lower part thereof being pressed toward the plurality of contact points, and a sliding receiving portion that comprises a stepped portion formed circumferentially on a side surface of the columnar main body and having a stepped surface on top thereof so as to restrict upward movement of the main body relative to the frame by contacting a lower end of the sliding protrusion with the stepped surface to position the pressing portion relative to the support in the vertical direction, and wherein the pressing portion is configured to move relative to the support in the vertical direction with the turning of the pressing portion by changing a vertical position of the stepped surface of the sliding receiving portion in a circumferential direction of the main body.

8. The connector according to claim 7, wherein the sliding receiving portion comprises a horizontal portion formed perpendicular to the vertical direction, and a slope formed to extend diagonally downward along the side surface of the main body from an end of the first horizontal portion.

9. The connector according to claim 8, wherein the first horizontal portion comprises a concave protrusion supporting portion for housing the lower end of the sliding protrusion.

10. The connector according to claim 7, wherein the sliding protrusion comprises an engagement portion for engaging the frame with the first terminal housing.

11. A connector, comprising:

a first terminal housing for housing a plurality of first connecting terminals aligned;

a second terminal housing for housing a plurality of second connecting terminals aligned;

a plurality of insulating members;

a laminated structure formed where one surface of the plurality of first connecting terminals faces one surface of the plurality of second connecting terminals to form pairs and to form a plurality of contact points sandwiched between the plurality of insulating members when the first terminal housing is fitted to the second terminal housing; and a connecting member for collectively fixing and electrically connecting the plurality of first connecting terminals and the plurality of second connecting terminals at each contact point by pressing the plurality of first connecting terminals and the plurality of second connecting terminals, wherein the connecting member comprises a ring-shaped support fixed to the first terminal housing and a pressing portion an upper part of which is inserted into a hollow formed inside the ring-shaped support so as to be pivotally supported by the support, wherein the support comprises a ring-shaped frame fixed to the first terminal housing and a sliding protrusion protruding downward from the frame, wherein the pressing portion comprises a columnar main body, a lower part thereof being pressed toward the plurality of contact points, and a sliding receiving portion that comprises a stepped portion formed circumferentially on a side surface of the columnar main body and having a stepped surface on top thereof so as to restrict upward movement of the main body relative to the frame by contacting a lower end of the sliding protrusion with the stepped surface to position the pressing portion relative to the support in the vertical direction, and wherein the pressing portion is configured to move relative to the support in the vertical direction with the turning of the pressing portion by changing a vertical position of the stepped surface of the sliding receiving portion in a circumferential direction of the main body.

* * * * *